US006008175A

United States Patent [19]

Scialla et al.

[11] Patent Number: 6,008,175

[45] Date of Patent: Dec. 28, 1999

[54] METHOD OF CLEANING CARPETS COMPRISING AN AMINEOXIDE OR ACYL SARCOSINATE AND A SOURCE OF ACTIVE OXYGEN

[75] Inventors: Stefano Scialla; Floriana Raso; Lorena Silvaggi, all of Rome, Italy

[73] Assignee: The Proctor & Gamble Company, Cincinnati, Ohio

[21] Appl. No.: 09/142,118

[22] PCT Filed: Feb. 20, 1997

[86] PCT No.: PCT/US97/02931

§ 371 Date: Sep. 4, 1998

§ 102(e) Date: Sep. 4, 1998

[87] PCT Pub. No.: WO97/32949

PCT Pub. Date: Sep. 12, 1997

[30] Foreign Application Priority Data

Mar. 4, 1996 [EP] European Pat. Off. ..... 96870024

[51] Int. Cl.[6] ..... C11D 1/75; C11D 1/10; C11D 3/39

[52] U.S. Cl. ..... 510/278; 510/279; 510/281; 510/286; 510/290; 510/302; 510/309; 510/405; 510/406; 510/414; 510/503

[58] Field of Search ..... 510/278, 279, 510/281, 286, 290, 302, 309, 405, 406, 414, 503

[56] References Cited

U.S. PATENT DOCUMENTS

| | | | |
|---|---|---|---|
| 3,639,290 | 2/1972 | Fearnley et al. | 252/545 |
| 3,723,323 | 3/1973 | Morgan et al. | 252/90 |
| 3,779,929 | 12/1973 | Abler et al. | 252/90 |
| 3,919,101 | 11/1975 | Anstett et al. | 252/90 |
| 4,090,974 | 5/1978 | Morganson | 252/135 |
| 4,203,859 | 5/1980 | Kirn et al. | 252/174.23 |
| 4,239,631 | 12/1980 | Brown | 252/8.75 |
| 4,388,204 | 6/1983 | Dimond et al. | 252/98 |
| 4,648,882 | 3/1987 | Osberghaus et al. | 8/142 |
| 4,652,389 | 3/1987 | Moll | 252/90 |
| 4,678,595 | 7/1987 | Malik et al. | 252/174.17 |
| 4,820,450 | 4/1989 | Wile et al. | 252/545 |
| 4,834,900 | 5/1989 | Soldanski et al. | 252/88 |
| 4,986,926 | 1/1991 | Hoffman | 252/102 |
| 5,259,848 | 11/1993 | Terry et al. | 8/111 |
| 5,338,475 | 8/1994 | Corey et al. | 252/102 |
| 5,486,315 | 1/1996 | Tseng | 252/547 |
| 5,573,710 | 11/1996 | McDonell | 510/405 |
| 5,813,086 | 9/1998 | Ueno et al. | 15/320 |
| 5,905,065 | 5/1999 | Scialla et al. | 510/280 |

FOREIGN PATENT DOCUMENTS

| | | | |
|---|---|---|---|
| 0 346 835 A2 | 12/1989 | European Pat. Off. | C11D 3/00 |
| 0 351 772 A2 | 1/1990 | European Pat. Off. | C01B 15/037 |
| 0 629 694 A1 | 12/1994 | European Pat. Off. | C11D 3/39 |
| 0 667 392 A2 | 8/1995 | European Pat. Off. | C11D 3/39 |
| WO 92/17634 | 10/1992 | WIPO | D06L 3/02 |
| WO 94/07980 | 4/1994 | WIPO | C11D 1/90 |

OTHER PUBLICATIONS

U.S. application No. 08/836,299, Scialla et al., filed May 12, 1997.

*Primary Examiner*—Yogendra Gupta
*Assistant Examiner*—Charles Boyer
*Attorney, Agent, or Firm*—Jason J. Camp; Robert B. Aylor

[57] ABSTRACT

A method of cleaning carpets with a composition comprising a surfactant selected from amine oxides and acyl sarcosinates. The compositions are advantageous in that they do not leave a dulling film if not removed from the carpet after drying. Preferably, the compositions also contain a source of active oxygen for stain removal.

23 Claims, No Drawings

METHOD OF CLEANING CARPETS COMPRISING AN AMINEOXIDE OR ACYL SARCOSINATE AND A SOURCE OF ACTIVE OXYGEN

TECHNICAL FIELD

The present invention relates to the cleaning of carpets.

BACKGROUND OF THE INVENTION

Carpets produced from synthetic or natural fibers and mixtures thereof are commonly used in residential and commercial applications as a floor covering. Various types of fibers can be used in making carpets such as polyamide fibers, polyester fibers as well as wool, cotton or even silk.

Carpets, irrespective of whether they are made from natural or synthetic fibers are all prone to soiling and staining when contacted with many household items. Indeed, fibers may become soiled as a result of various items like foods, grease, oils, beverages as well as dirt particles, clay, dust, particulate soils in general, coming into contact with and adhering to the fibers of the carpets. These latter soils often appear in the form of a diffuse layer of soils rather than in the form of spots and tend to accumulate particularly in the so called "high traffic areas" such as near doors as a result of intensive use of the carpets in such areas.

There are a number of carpet cleaning compositions described in the art for removing stains and/or soils from carpets. However, these compositions leave a lot of residues on the carpets after having been applied and left in contact with said carpets to perform their cleaning action. The residues left onto said carpets by said carpet cleaning compositions have the tendency to stick to said carpets and are thus difficult to remove by mechanical means for example by vacuum cleaning. The presence of high amount of residues and in particular of sticky residues, contributes to facilitate carpet resoiling and to make the carpet lose its "new" aspect and colour brightness.

Thus the object of the present invention is to provide a method of cleaning carpets whereby the amount of residues left onto said carpets after having been applied thereto is reduced. A further object of the present invention is to provide a method of cleaning a carpet that provides excellent stain removal performance without the need of removing from said carpet the carpet cleaning composition that has been applied thereto to clean said carpet.

It has now been found that the above object can be met by incorporating an amine oxide surfactant according to the formula R1R2R3NO, wherein each of R1, R2 and R3 is independently a saturated substituted or unsubstituted, linear or branched alkyl group of from 1 to 30 carbon atoms, and/or an acyl sarcosinate surfactant according to the formula:

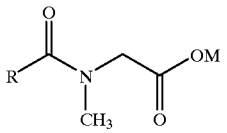

wherein M is hydrogen or a cationic moiety and wherein R is an alkyl group of from 9 to 20 carbon atoms, in a carpet cleaning composition. Indeed, it has now been found that the use of such a surfactant in a carpet cleaning composition allows to reduce the amount of residues left onto a carpet that has been contacted with said carpet cleaning composition. It has further been found that the residues left are at least partially crystals with an average particle surface bigger than $300\mu^2$. More particularly, the present invention is based on the consumer noticeable finding that excellent stain removal performance is delivered with a composition comprising such an amine oxide surfactant and/or acyl sarcosinate surfactant without the need of removing said composition from the carpet after having been applied thereto and having performed its cleaning action. Thus the present invention allows a one step carpet cleaning method with excellent stain removal performance. Furthermore, if a removing step although not necessary is nevertheless carried out by for example vacuum cleaning said carpet after having applied thereto said composition, said removing step is facilitated. Indeed, the residues left onto a carpet when cleaned with a carpet cleaning composition according to the present invention can be easily removed from said carpet, for example by vacuum cleaning, as compared to the residues left onto said carpet when cleaned with the same composition without said surfactant according to the present invention, or with the same composition but with alkyl sulphate instead of said surfactant according to the present invention.

An advantage of the present invention is that it is applicable to all carpet types, especially delicate natural fibers and is also safe to all carpet dye types, particularly sensitive natural dyes used therein. The compositions suitable to be used herein are also particularly efficient to clean upholstery and car seats covering.

Another advantage is that the compositions to be used according to the present invention may be applied directly on the carpet without causing damage to the carpet. In addition the cleaning action of the invention commences as soon as the carpet cleaning composition has been applied to the surface. Indeed, the use of the carpet cleaning compositions of the present invention does not necessarily require rubbing or/and brushing of the carpet.

A further advantage of the present invention is that excellent stain removal performance is provided on a variety of stains including particulate stains like clay, dirt, dust, mud, concrete, greasy/oily stains like make-up, lipstick, dirty motor oil, mineral oil, greasy food like mayonnaise and spaghetti sauce, bleachable stains like tea, wine, grass and coffee as well as enzymatic stains like blood.

Yet another advantage of the preferred embodiment of the present invention where said carpet cleaning method is carried out without removing said carpet cleaning composition from a carpet after having been applied and left to dry onto said carpet, is that when said carpet cleaning composition further comprises a perfume, said perfume is longer lasting on carpets. This results in improved fragrance odor of carpets being cleaned. In other words, the method of cleaning carpets according to the present invention wherein the carpet cleaning composition used further comprises a perfume and wherein said composition is not removed from said carpets after having been applied thereto, provides a fresh and clean impression to carpets.

SUMMARY OF THE INVENTION

The present invention encompasses a method of cleaning a carpet wherein a composition comprising an amine oxide surfactant according to the formula R1R2R3NO, wherein each of R1, R2 and R3 is independently a saturated substituted or unsubstituted, linear or branched alkyl group of from 1 to 30 carbon atoms, and/or an acyl sarcosinate surfactant according to the formula

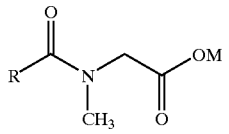

wherein M is hydrogen or a cationic moiety and wherein R is an alkyl group of from 9 to 20 carbon atoms, is applied to said carpet in a liquid form, optionally rubbed and/or brushed and left to dry without removing it from said carpet.

In another embodiment, the present invention encompasses a method of cleaning carpet which includes the steps of applying said composition herein in a liquid form onto said carpet, optionally rubbing and/or brushing and leaving it to dry before removing it from said carpet, preferably by mechanical means including brushing out and/or vacuum cleaning.

The present invention further encompasses the use of a cleaning composition comprising an amine oxide surfactant according to the formula R1R2R3NO, wherein each of R1, R2 and R3 is independently a saturated substituted or unsubstituted, linear or branched alkyl group of from 1 to 30 carbon atoms and/or an acyl sarcosinate surfactant according to the formula

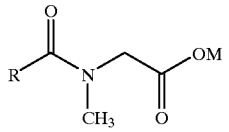

wherein M is hydrogen or a cationic moiety and wherein R is an alkyl group of from 9 to 20 carbon atoms, preferably a pure-cut amine oxide surfactant and/or a pure-cut acyl sarcosinate surfactant, for cleaning a carpet, to reduce the amount of residues left onto said carpet after said composition has been applied and left to act thereto.

The present invention also encompasses the use of a cleaning composition comprising an amine oxide surfactant according to the formula R1R2R3NO, wherein each of R1, R2 and R3 is independently a saturated substituted or unsubstituted, linear or branched alkyl group of from 1 to 30 carbon atoms, and/or an acyl sarcosinate surfactant according to the formula

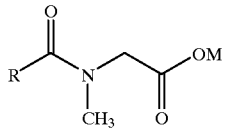

wherein M is hydrogen or a cationic moiety and wherein R is an alkyl group of from 9 to 20 carbon atoms, preferably a pure-cut amine oxide surfactant and/or a pure-cut acyl sarcosinate surfactant, for the cleaning of a carpet, whereby the residues left onto said carpet are at least partially crystals with an average particle surface bigger than $300\mu^2$.

All amounts, percentages and ratios are given by weight of the total composition in its neat form unless otherwise stated.

DETAILED DESCRIPTION OF THE INVENTION

The present invention encompasses a method of cleaning a carpet with a composition comprising an amine oxide surfactant and/or an acyl sarcosinate surfactant, wherein said composition is applied to said carpet in a liquid form, optionally rubbed and/or brushed and left to dry, without the need of removing said composition from said carpet to get excellent stain removal performance.

The compositions suitable to be used according to the present invention may be formulated either as solids or liquids. In liquid form, the compositions are preferably but not necessarily formulated as aqueous compositions. Liquid compositions are preferred herein for convenience of use. In the case where the compositions are formulated as solids for example as granular compositions or powder compositions, they are applied on the carpets to be treated according to the present invention in a liquid form. Indeed, by "in a liquid form" it is meant herein the liquid compositions per se in neat or diluted form as well as the granular or powder compositions that have been diluted with an appropriate solvent, typically water, before use, i.e., before being applied onto said carpet.

By "diluted form" it is meant herein that the compositions for the cleaning of carpets according to the present invention may be diluted by the user, preferably with water. Said compositions can be diluted up to 150 times, preferably up to 50 times and more preferably up to 25 times.

As an essential ingredient, the compositions to be used according to the present invention comprise an amine oxide surfactant and/or an acyl sarcosinate surfactant.

Suitable amine oxide surfactants to be used herein are according to the following formula $R_1R_2R_3NO$ wherein each of R1, R2 and R3 is independently a saturated substituted or unsubstituted, linear or branched alkyl group of from 1 to 30 carbon atoms, and preferably of from 1 to 20 carbon atoms, or mixtures thereof. Particularly preferred amine oxide surfactants to be used according to the present invention are amine oxide surfactants having the following formula $R_1R_2R_3NO$ wherein R1 is a saturated linear or branched alkyl group of 1 to 30 alkyl group, preferably of 6 to 20 alkyl group, more preferably of 6 to 16 and wherein R2 and R3 are independently substituted or unsubstituted, linear or branched alkyl groups of from 1 to 4 carbon atoms, preferably of from 1 to 3 carbon atoms, and more preferably are methyl groups, or mixtures thereof.

In a preferred embodiment of the present invention the amine oxide surfactants used herein are pure-cut amine oxide surfactants, i.e., an amine oxide surfactant of one chain length, e.g., C8 N,N, dimethyl amine oxide, as opposed to mixtures of amine oxide surfactants of different chain lengths. Indeed, it is with said pure-cut amine oxide surfactant preferably as the sole surfactant in the compositions suitable to be used herein that the amount of residues left onto said carpets is the most reduced and/or that the residues left are almost all crystals with an average particle surface bigger than $300\mu^2$.

Suitable amine oxide surfactants to be used herein are natural blend of C8–C14 amine oxides. Suitable pure-cut amine oxide surfactants for use herein are for instance C10 amine oxides, C8 amine oxides as well as C14 amine oxides. Amine oxide surfactants are commercially available from Hoechst under the trade name Genaminox.

Suitable acyl sarcosinate surfactants to be used herein are according to the following formula, or mixtures thereof:

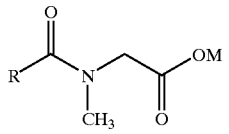

wherein M is hydrogen or a cationic moiety and wherein R is an alkyl group of from 9 to 20 carbon atoms, preferably of from 11 to 15 carbon atoms and more preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

In a preferred embodiment of the present invention said acyl sarcosinate surfactants used herein are pure-cut acyl sarcosinate surfactants, i.e., an acyl sarcosinate surfactant of one chain length, e.g., C14 acyl sarcosinate, as opposed to mixtures of acyl sarcosinate surfactants of different chain lengths. Indeed, as for the pure-cut amine oxide surfactants herein, it is with said pure-cut acyl sarcosinate surfactant preferably as the sole surfactant in the compositions suitable to be used herein that the amount of residues left onto said carpets is the most reduced and/or that the residues left are almost all crystals with an average particle surface bigger than $300\mu^2$.

Particularly preferred acyl sarcosinate surfactant is C14 acyl sarcosinate (i.e. an acyl sarcosinate surfactant according to the above formula wherein M is hydrogen and R is an alkyl group of 13 carbon atoms). Said acyl sarcosinate surfactant may be commercially available, for example, as Hamposyl M-30® supplied by Hampshire.

Typically, the compositions of the present invention comprise from 0.01% to 20% by weight of the total composition of said amine oxide surfactant and/or said acyl sarcosinate surfactant, preferably from 0.01% to 10%, and more preferably from 0.1% to 8%.

It has now been found that said amine oxide surfactants and/or said acyl sarcosinate surfactants have the advantage to reduce the amount of residues left onto carpets which have been treated with a composition comprising said surfactants, as compared to the same composition with another surfactant like alkyl sulphate instead of said surfactants according to the present invention. Also, the residues left after a composition suitable to be used according to the present invention has performed its cleaning action onto said carpet, are at least partially in a crystalline form (generally lamellar and/or needle-shaped) with an average particle surface bigger than $300\mu^2$. According to the preferred embodiment of the present invention at least 80% of the total amount of residues left onto said carpet are crystals with an average particle surface bigger than $300\mu^2$, more preferably at least 90%, and most preferably at least 95%.

Crystal forms of the residues and the amount of residues left onto the carpets after having applied thereto a cleaning composition, can be evaluated/identified by observation of product residues after water evaporation under optical microscope on glass slides and on carpet piles. Crystal residues can be identified on a video screen (in video enhanced microscopy) and their dimensions can be measured for instance with the help of a videomicrometer VM-1000 or measured directly on the photograph.

An advantage of the present invention is that after having been in contact with a composition according to the present invention, carpets maintain their aspect and do not resoil because of sticky residues on their surface. In fact the residues left by the compositions used to clean carpets according to the present invention are in such a low quantity that they do not affect carpet appearance. This results in the benefit that the compositions suitable to be used according to the present invention do not need to be removed from said carpet after having been applied thereto.

A further advantage of the present invention is that excellent stain removal performance is obtained on a variety of stains including particulate stains, greasy stains, bleachable stains and enzymatic stains, this even without the need of removing said carpet cleaning composition from the carpet after having been applied thereto and left to dry. Indeed, it has been observed that improved stain removal performance is obtained on a variety of stains with the compositions according to the present invention, as compared to the same compositions without said amine oxide surfactant and/or acyl sarcosinate surfactant, or with the same compositions with other surfactants like C12 alkyl sulfate instead of said amine oxide surfactant and/or acyl sarcosinate surfactant.

In a preferred embodiment, the present invention encompasses a method of cleaning a carpet with a composition according to the present invention which comprises the steps of applying said composition in a liquid form onto said carpet, optionally rubbing and/or brushing said carpet, then leaving said composition to dry onto said carpet without removing it from said carpet. An advantage of the present invention is that the cleaning action of the compositions suitable to be used herein commences as soon as said compositions are applied onto said carpet. Thus, the cleaning process of the present invention does not necessarily require rubbing and/or brushing. It is only in the case of highly soiled carpets or in the so called "high traffic areas" that the carpet may be cleaned by applying onto it said composition for the cleaning of carpets according to the present invention, then rubbing and/or brushing it more or less intensively for example by means of a sponge or a brush or other mechanical/electrical device, optionally with the aid of water. In general, the rubbing/brushing-times are between 0.1 to a few minutes per square meters.

In another embodiment, the present invention encompasses a method of cleaning carpet with a composition according to the present invention which comprises the steps of applying onto said carpet said composition in a liquid form, optionally rubbing and/or brushing said carpet, then leaving said composition to dry onto said carpet before removing it from said carpet preferably by mechanically means including brushing out and/or vacuum cleaning, said latter step being facilitated. By facilitated it is meant herein that less effort may be required from the user to remove the residues that may have been left onto said carpet. Indeed, the low amount of residues formed according to the present invention and their nature, i.e., crystals forms, allow the residues that may be present, to be removed more easily from said carpet, if such a removal step is carried out, for example, by vacuum cleaning, as opposed to residues being sticky and thus difficult to remove from said carpet.

Said compositions according to the present invention in a liquid form may be applied directly onto the area to be treated or applied using a cloth or piece of material such as spraying device or aerosol can, a sponge, a brush or other mechanical/electrical device. Preferably said composition in a liquid form is applied to the area to be treated by using a spraying device or an aerosol can. Such a spraying device may be trigger operated or pump operated or electrically operated or operated by any source of pressurised gas such as a can or a pressurizer. Such spraying devices are particularly preferable if a large area is to be treated as it facilitates the ease of use for the consumer. The spraying devices ensure uniform coverage of the area to be treated and maximises the advantage of the using liquid aqueous compositions containing peroxides. This is because the application of product by spray best allows the product to be left to dry on the area treated, even without rubbing or brushing. This optimises the action time of the composition and allows the best exploitation of the bleaching action of peroxides, if present.

The area to be treated using the compositions according to the present invention may be any size. In addition, a complete section or even a whole carpet may be applied with the composition for the cleaning of carpets according to the present invention. For such purposes when using a liquid aqueous composition a spraying device with a pump to allow prolonged spraying is particularly useful.

The amount of the compositions for the cleaning of carpets according to the present invention applied will depend on the severity of the stains or soils. In the case of stubborn stains more than one application may be required to ensure complete removal of the stain. The carpet cleaning compositions may also be used in order to remove the dinginess of the carpet resulting from a diffused layer of soil which results from general wear.

The compositions for the cleaning of carpets according to the present invention may be used both for manual carpet cleaning and carpet cleaning machines. For carpet cleaning machines the compositions for the cleaning of carpets according to the present invention, i.e. either liquid compositions or granular compositions or powder compositions that will be diluted to be in a liquid form according to the machine operating instructions. Furthermore, compositions to be used in such machines should be formulated to prevent high sudsing. Such compositions may thus comprise suds suppressing agents.

The compositions suitable to be used according to the present invention may further comprise as an optional but highly preferred ingredient a source of active oxygen or mixtures thereof. Preferred compositions herein are liquid aqueous compositions comprising a source of active oxygen that have the advantage, due to the presence of said amine oxide surfactants and/or acyl sarcosinate surfactants, to be particularly efficient in terms of overall stain removal performance and to be chemically stable. Indeed, said liquid aqueous compositions according to the present invention do not require pH adjustment prior to use and can be stored for long periods of time prior to use.

A preferred source of active oxygen according to the present invention is hydrogen peroxide or sources thereof. As used herein a hydrogen peroxide source refers to any compound which produces hydrogen peroxide when said compound is in contact with water. Suitable water-soluble sources of hydrogen peroxide for use herein include percarbonates, metal peroxides and perborates.

In addition, other classes of peroxides can be used as an alternative to hydrogen peroxide and sources thereof or in combination with hydrogen peroxide and sources thereof. Suitable classes include dialkylperoxides, diacylperoxides, preformed percarboxylic acids, persilicates, persulphates, organic and inorganic peroxides and/or hydroperoxides.

Suitable organic and inorganic peroxides/hydroperoxides for use in the compositions according to the present invention include diacyl and dialkyl peroxides/hydroperoxides such as dibenzoyl peroxide, t-butyl hydroperoxide, dilauroyl peroxide, dicumyl peroxide, persulphuric acid and mixtures thereof.

Suitable preformed peroxyacids for use in the compositions for the cleaning of carpets according to the present invention include diperoxydodecandioic acid DPDA, magnesium perphthalatic acid, perlauric acid, perbenzoic acid, diperoxyazelaic acid and mixtures thereof.

Accordingly, the compositions suitable to be used according to the present invention comprise from 0.1% to 15%, preferably from 0.5% to 10%, more preferably from 1 % to 7% by weight of active oxygen in said composition.

As used herein, active oxygen concentration refers to the percentage concentration of elemental oxygen, with an oxidation number zero, that, being reduced to water, would be stoichiometrically equivalent to a given percentage concentration of a given peroxide compound, when the peroxide functionality of the peroxide compound is completely reduced to oxides. The active oxygen sources according to the present invention increase the ability of the compositions to remove colored stains, to destroy malodorous molecules and to kill germs.

The concentration of available oxygen can be determined by methods known in the art, such as the iodimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

The compositions suitable to be used according to the present invention may further comprise a bleach activator or mixtures thereof, as another optional ingredient. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides.

Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactam selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmentally friendly as it eventually degrades into citric acid and alcohol. Furthermore, acetyl triethyl citrate has a good hydrolytical stability in the composition upon storage and it is an efficient bleach activator. As used herein and unless otherwise specified, the term bleach activator includes mixtures of bleach activators.

The compositions suitable to be used according to the present invention may comprise up to 30% by weight of the total composition of said bleach activator, or mixtures thereof, preferably from 1% to 20%, and more preferably from 2% to 10%.

The pH of the liquid compositions suitable to be used according to the present invention can be from 0 to 14. In a preferred embodiment, wherein the liquid compositions herein comprise a source of active oxygen, the recommended pH range to achieve good hydrogen peroxide stability is from 1 to 9, preferably between pH 1 and 8, more preferably between pH 1 and 7 and most preferably between 1 and 6. Accordingly, the compositions herein may further comprise an acid to adjust pH. In addition, some acids can have the advantage that they can form small concentrations of the corresponding peracids by reaction with hydrogen peroxide in-situ, thus enhancing the overall performance of the composition. These acids can be further selected so as to have chelating and/or building properties. The acids of the present invention that may be used for these purposes can be organic or inorganic acids, preferably organic acids such as citric, maleic, oxalic succinic, and tartaric acids or inorganic acids such as sulphuric acid.

The compositions suitable to be used according to the present invention may comprise a chelating agent or mixtures thereof, as a highly preferred optional ingredient. Chelating agents suitable to be used herein include chelating agents selected from the group of phosphonate chelating agents, amino carboxylate chelating agents, polyfunctionally-substituted aromatic chelating agents, and further chelating agents ethylenediamine N,N'-disuccinic acids, and mixtures thereof.

Suitable phosphonate chelating agents to be used herein may include ethydronic acid as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates. Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitute ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanoldiglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylate to be used herein is diethylene triamine penta acetic acid.

Other chelating agents suitable to be used herein include salicylic acid and derivatives thereof. Salicylic acid may be commercially available from Rhone-Poulenc under the name Salicylic Acid®. Indeed, it has been observed that the addition of salicylic acid on top of an amine oxide surfactant results in a synergistic effect on the stain removal performance on a variety of stains including particulate stains and/or greasy/oily stains and/or bleachable stains, this especially in the method of cleaning carpets according to the present invention.

The compositions suitable to be used according to the present invention comprise up to 5% by weight of the total composition of said chelating agent or mixtures thereof, preferably from 0.1% to 4% and more preferably from 0.1% to 2%.

The compositions suitable to be used herein may also comprise soil suspending polycarboxylate polymers. Any soil suspending polycarboxylate polymer known to those skilled in the art can be used according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates to be used herein can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic/acrylic acid with an average molecular weight of about 70,000. Such copolymers are commercially available from BASF under the trade name SOKALAN CP5.

The compositions suitable to be used herein may also comprise soil suspending polyamine polymers as optional ingredients. Any soil suspending polyamine polymer known to those skilled in the art may also be used herein. Particularly suitable polyamine polymers for use herein are polyalkoxylated polyamines. Such materials can conveniently be represented as molecules of the empirical structures with repeating units:

Amine form

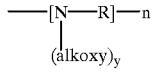

and

Quaternized form

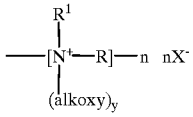

wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula:

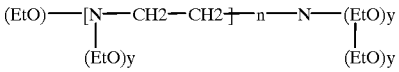

when y=2–30. Particularly preferred for use herein is an ethoxylated polyethylene amine, in particular ethoxylated tetraethylenepentamine, and quaternized ethoxylated hexamethylene diamine.

The compositions suitable to be used herein may further comprise other additional compounds such as other surfactants, builder system, solvents, perfumes, dyes, suds suppressing agents, enzymes, photobleaching agents, other chelating agents and other minors. Where the compositions herein comprise a source of active oxygen, the optional ingredients are selected so that they are compatible with said source of active oxygen.

Solvents suitable for use herein may be selected from octyl alcohol, isopropyl alcohol, propyl alcohol, ethoxypropoxy alcohol, buthoxypropoxy alcohol and/or furfuryl alcohol.

Pyrocatechol is a highly preferred optional ingredient to be used in the liquid compositions according to the present invention. The liquid compositions according to the present invention comprise up to 5% by weight of the total composition of pyrocatechol, preferably from 0.01% to 1%, and more preferably from 0.01% to 0.5%.

Pyrocatechol improves the chemical stability of the liquid compositions of the present invention that further comprise a source of active oxygen, i.e. lower the decomposition of the bleach and the bleach activator, if present. Indeed, it is believed that the chemical stabilising effect of pyrocatechol is twofold. Firstly, they may work as radical scavengers and secondly, they may interact with the hydrogen peroxide preventing or limiting hydrolysis, therefore reducing the rate of peroxide decomposition.

Surfactants suitable for use herein are well known in the art and include anionic, nonionic, zwitterionic and cationic surfactants and mixtures thereof.

The anionic surfactants which may be used herein include alkali metal salts of alkyl substituted benzene sulphonates, alkali metal alkyl sulphonates, alkali metal alkyl sulphates and alkali metal alkyl ether sulphates derived from for example fatty alcohols and alkyl phenols, alkali metal alkane sulphonates, alkali metal olefin sulphonates and alkali metal sulphosuccinates and alkyl succinates, whereby the sodium salts are preferred, alkyl carboxylates and alkyl ether carboxylates.

The nonionic surfactants which may be used herein include any liquid or solid ethoxylated $C_6$–$C_{24}$ fatty alcohol nonionic surfactant, alkyl ethoxylates/propoxylates and mixtures thereof, fatty acid $C_6$–$C_{24}$ alkanolamides, $C_6$–$C_{20}$ polyethylglycol ethers, polyethylene glycol with molecular weight 1000 to 80000 and glucose amides, alkyl pyrrolidones, betaines.

Suitable cationic surfactants for use herein include quaternary ammonium compounds of the formula $R_1R_2R_3R_4N^+$ where $R_1$,$R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group.

Zwitterionic surfactants are also suitable optional ingredients for use herein. Suitable zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulphonates and sulfates disclosed in U.S. Pat. Nos. 3,925,262, Laughlin et al., issued Dec. 9, 1975 and 3,929,678, Laughlin et al., issued Dec. 30, 1975. The compositions herein comprise up to 70% by weight, preferably from 0.1% to 50% by weight of the total composition of a surfactant or mixtures thereof.

The compositions suitable to be used according to the present invention may further comprise a builder system. Any conventional builder system is suitable for use herein. Suitable builders for use herein include citric acid, preferably in the form of a water-soluble salt, derivatives of succinic acid of the formula R_CH(COOH)$CH_2$(COOH) wherein R is $C_{10-20}$ alkyl or alkenyl, preferably $C_{12-16}$, or wherein R can be substituted with hydroxyl, sulpho sulphoxyl or sulphone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium, ammonium and alkanolammonium salts.

Other suitable builders are oxodisuccinates and mixtures of tartrate monosuccinic and tartrate disuccinic acid such as described in U.S. Pat. No. 4,663,071.

Further suitable builders for use herein are fatty acid builders including saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

A preferred builder system for use herein consists of a mixture of citric acid, fatty acids and succinic acid derivatives described herein above. The compositions herein may comprise from 0% to 10%, preferably from 1% to 7% by weight of the total composition of a builder system.

The compositions suitable to be used according to the present invention may further comprise a perfume or mixtures thereof. Suitable perfumes to be used herein include materials which provide an olfactory aesthetic benefit and/or cover any "chemical" odor that the composition may have. The function of a small fraction of the highly volatile, low boiling (having low boiling points) perfume ingredients is mainly to improve the fragrance odor of the carpet composition itself but also to impact on the subsequent odor of carpets being cleaned. Also, some of the less volatile, high boiling perfume ingredients provide a fresh and clean impression to carpets, and it is desirable that these perfume ingredients be deposited and be present on said surfaces. Perfume ingredients can be readily solubilized in compositions, for instance by the surfactants present in said compositions. The perfume ingredients and compositions suitable to be used herein are the conventional ones known in the art. Selection of any perfume compound and composition, or amount of perfume, is based on stability tests, performance tests and aesthetic considerations.

Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. In general, the degree of substantivity of a perfume is roughly proportional to the percentages of substantive perfume material used. Relatively substantive perfumes contain at least about 1%, preferably at least about 10%, substantive perfume materials. Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 and above, and are detectable at levels below those of the average perfume material. Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, para-cymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linatyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other C15H24 sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy-4-methyl pentyl)-3-cyclohexene-10-carboxaldehyde), methyl cedryl one, methyl dihydro jasmonate, methyl-beta-naphthyl ketone, musk indanone, musk ketone, musk tibetene, and phenyl-ethyl phenyl acetate.

An advantage of the preferred embodiment of the present invention where said carpet cleaning method is carried out without removing said carpet cleaning composition from a carpet after having been applied and left to dry onto said carpet, is that when said carpet cleaning composition further comprises a perfume, said perfume is longer lasting on carpets. This results in improved fragrance odor of carpets being cleaned. In other words, the method of cleaning carpets according to the present invention wherein the carpet cleaning composition used further comprises a perfume and wherein said composition is not removed from said carpet, provides a fresh and clean impression to carpets.

EXAMPLES

The following examples will illustrate the present invention. The compositions are made by combining the listed ingredients in the listed proportions (weight % unless otherwise specified).

| Compositions | I | II | III | IV | V | VI | VII |
|---|---|---|---|---|---|---|---|
| Hydrogen peroxide | 6.0 | 6.0 | 7.0 | 7.0 | 7.0 | 7.0 | 7.0 |
| PA | 1.0 | — | 1.0 | 1.0 | 1.0 | — | 1.0 |
| DETPMP | — | 0.2 | — | — | — | 0.2 | — |
| MA/AA | — | 1.0 | — | — | — | 1.0 | — |
| NaCnAS | — | 1.0 | — | — | — | 1.0 | — |
| C8 Amine oxide | 2.0 | 2.0 | 2.0 | — | — | 2.0 | 2.0 |
| C14 amine oxide | 1.0 | — | — | — | — | — | — |
| C14 acyl sarcosinate | — | — | — | 3.0 | 1.5 | 1.0 | 1.0 |
| Perfume | 0.4 | 0.2 | 0.4 | 0.2 | 0.2 | — | 0.2 |
| Water and minors | | | | Balance | | | |

DETPMP is diethylene triamine penta methylene phosphonic acid available from Monsanto under the trade name Dequest 2060 or Dequest 4060. MA/AA is copolymer of maleic/acrylic acid, average molecular weight about 70,000. PA is an ethoxylated tetraethylenepentamine, average molecular weight about 70,000. NaCnAS is sodium alkylsulphate.

When cleaning carpets with the carpet cleaning compositions of the above examples excellent cleaning performance on a variety of stains/soils including particulate stains, greasy/oily stains, bleachable stains like coffee, beverages and enzymatic stains like blood is obtained while the amount of residues left onto said carpet is reduced. Indeed, said carpet cleaning compositions provide excellent stain removal even when applying them on carpets, leaving them to dry without subsequently removing them from said carpets.

We claim:

1. A method of cleaning a carpet wherein a composition comprising from 0.01% to 20% of an amine oxide surfactant according to the formula $R_1R_2R_3NO$, wherein each of $R_1$, $R_2$ and $R_3$ is independently a saturated substituted or unsubstituted, linear or branched alkyl group of from 1 to 30 carbon atoms, and/or an acyl sarcosinate surfactant according to the formula

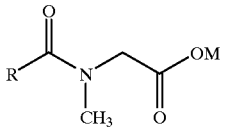

wherein M is hydrogen or a cationic moiety and wherein R is an alkyl group of 9 to 20 carbon atoms, and from 0.5% to 10% of active oxygen, is applied to said carpet in an aqueous liquid form, optionally rubbed and/or brushed and left to dry without removing it from said carpet.

2. A method according to claim 1 wherein said composition is a liquid aqueous composition applied neat or diluted to said carpet, or a granular or a powder composition which has been diluted typically with water before being applied to said carpet in said liquid form.

3. A method according to claim 1 wherein said composition is used in a carpet cleaning machine.

4. A method according to claim 1 wherein said composition is applied to said carpet by means of a spraying device or an aerosol can.

5. A method according to claim 1 wherein said composition comprises from about 0.01% to about 10% by weight of the total composition of said amine oxide surfactant and/or said acyl sarcosinate surfactant.

6. A method according to claim 1 wherein said amine oxide surfactant is according to the formula $R_1R_2R_3NO$ wherein $R_1$ is a saturated linear or branched alkyl group of 1 to 30 carbon group and wherein $R_2$ and $R_3$ are independently substituted or unsubstituted, linear or branched alkyl groups of from about 1 to about 4 carbon atoms.

7. A method according to claim 1 wherein said amine oxide surfactant is a pure-cut amine oxide surfactant.

8. A method according to claim 1 wherein said acyl sarcosinate is according to the formula:

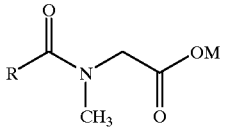

wherein M is hydrogen or a cationic moiety and wherein R is an alkyl group of from about 11 to about 15 carbon atoms, or mixtures thereof.

9. A method according to claim 1 wherein said acyl sarcosinate surfactant is a pure-cut acyl sarcosinate surfactant.

10. A method according to claim 1 wherein said composition comprises from 1% to 7% by weight of active oxygen in said composition.

11. A method according to claim 1 wherein said composition further comprises an ingredient selected from the group consisting of chelating agents, bleach activators, soil suspending polycarboxylate and/or polyamine polymers, builders, solvents, perfumes, dyes, suds suppressing agents, enzymes, photobleaching agents and mixtures thereof.

12. A method of cleaning a carpet wherein a composition comprising from 0.01% to 20% of an amine oxide surfactant according to the formula $R_1R_2R_3NO$, wherein each of $R_1$, $R_2$ and $R_3$ is independently a saturated substituted or unsubstituted, linear or branched alkyl group of from about 1 to about 30 carbon atoms, and/or an acyl sarcosinate surfactant according to the formula

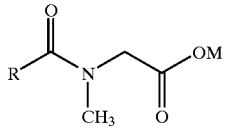

wherein M is hydrogen or a cationic moiety and wherein R is an alkyl group of about 9 to about 20 carbon atoms, and from 0.5% to 10% of active oxygen, is applied to said carpet in a liquid aqueous form, optionally rubbed and/or brushed, and left to dry before removing it from said carpet, by mechanical means including brushing out and/or vacuum cleaning, whereby said removing step is facilitated.

13. A method according to claim 12 wherein said amine oxide surfactant is according to the formula $R_1R_2R_3NO$ wherein $R_1$ is a saturated linear or branched alkyl group of 1 to 30 carbon group and wherein $R_2$ and $R_3$ are independently substituted or unsubstituted, linear or branched alkyl groups of from about 1 to about 4 carbon atoms.

14. A method according to claim 12 wherein said amine oxide surfactant is a pure-cut amine oxide surfactant.

15. A method according to claim 12 wherein said acyl sarcosinate is according to the formula:

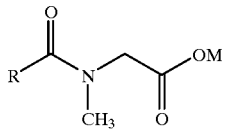

wherein M is hydrogen or a cationic moiety and wherein R is an alkyl group of from about 11 to about 15 carbon atoms, or mixtures thereof.

16. A method according to claim 12 wherein said acyl sarcosinate surfactant is a pure-cut acyl sarcosinate surfactant.

17. A method according to claim 12 wherein said composition comprises from about 1% to about 7% by weight of active oxygen in said composition.

18. The method of claim 6 wherein $R_1$ is a 6 to 20 carbon alkyl group and $R_2$ and $R_3$ are methyl groups.

19. The method of claim 9 wherein the acyl sarcosinate is a $C_{14}$ acyl sarcosinate.

20. The method of claim 10 wherein the active oxygen is in the form of hydrogen peroxide or a source thereof.

21. The method of claim 13 wherein $R_1$ is a 6 to 20 carbon alkyl group and $R_2$ and $R_3$ are methyl groups.

22. The method of claim 16 wherein the acyl sarcosinate is a $C_{14}$ acyl sarcosinate.

23. The method of claim 17 wherein the active oxygen is in the form of hydrogen peroxide.

* * * * *